US007528317B2

(12) United States Patent
Samuel

(10) Patent No.: US 7,528,317 B2
(45) Date of Patent: May 5, 2009

(54) HARMONIC ANALYSIS

(76) Inventor: Joseph Patrick Samuel, 53 Hampstead Road, Brighton, BN1 5NG (GB)

( * ) Notice: Subject to any disclaimer, the term of this patent is extended or adjusted under 35 U.S.C. 154(b) by 70 days.

(21) Appl. No.: 11/677,239

(22) Filed: Feb. 21, 2007

(65) Prior Publication Data

US 2008/0196576 A1 Aug. 21, 2008

(51) Int. Cl.
*G10H 1/38* (2006.01)

(52) U.S. Cl. ..... 84/613; 84/609; 84/637; 84/669

(58) Field of Classification Search ..... None
See application file for complete search history.

(56) References Cited

U.S. PATENT DOCUMENTS 5,663,517 A * 9/1997 Oppenheim ..... 84/649
6,331,668 B1 * 12/2001 Michero ..... 84/477 R
6,987,220 B2 * 1/2006 Holcombe ..... 84/483.2
2002/0005109 A1 * 1/2002 Miller ..... 84/609
2004/0144238 A1 * 7/2004 Gayama ..... 84/613
2004/0200335 A1 * 10/2004 Phillips ..... 84/483.2
2006/0027080 A1 * 2/2006 Schultz ..... 84/613
2006/0070510 A1 * 4/2006 Gayama ..... 84/613

* cited by examiner

*Primary Examiner*—Marlon T Fletcher
(74) *Attorney, Agent, or Firm*—Howard & Howard Attorneys PLLC

(57) ABSTRACT

The invention provides methods and apparatuses for creating a two-dimensional graphical representation of music which has been analysed into a chord sequence, by evaluating a first parameter of each chord, e.g. the harmonic root, determining a first display coordinate for each chord in dependence on the evaluated first parameter, determining a second display coordinate for each chord within the sequence in dependence on the time of occurrence of each chord within the sequence, and displaying the chords graphically at positions defined by the determined.

27 Claims, 10 Drawing Sheets

| Symbol | Type of Chord |
|---|---|
| ⊡ | Suggested Harmony |
| Ø | Half Diminished |
| ○ | Diminished |
| + | Augmented |
| ◇ | Minor |
| ◆ | Minor Root |
| ■ | Major Root |
| □ | Major |
| ▣ | Dominant 7 |
| △ | Major 7 |
| sus4 | Suspended 4th |
| sus2 | Suspended 2nd |
| 9,11,13 | Add 9,11,13 |
| ♭♯ | Altered |

Fig. 4

- Relative major/minor

- Tritone

- Any other adjacent chords.

- Cadence

HARMONIC ANALYSIS

The invention relates to the analysis of musical harmony. In particular, the invention relates to the graphical display of chord sequences within music.

BACKGROUND OF THE INVENTION

All music is based to a large extent on harmonic progressions, namely sequences of combinations of notes or chords which define underlying harmonic changes. However, conventional Western musical notation is based on a stave, known in the USA as a staff. An example of such notation is illustrated in FIG. 1, which represents in conventional musical notation the first sixteen bars of Bach's First Prelude from the Well Tempered Clavier Book I. The chord described by each section of music is shown above the stave.

Musicians and composers have long known about the inadequacies of stave notation with respect to chords and harmonies. For example, the harmonic relationship between sequential chords cannot be indicated on a stave, and it is therefore difficult to appreciate any patterns that may be present within a chord sequence.

Newcomers to music often find it difficult to understand and recall the appropriate patterns in chord sequences. For example, several notes may be played simultaneously to produce a chord, but if one of those notes is omitted or replaced by another note, the chord may change significantly. Such subtle differences are difficult for beginners to observe in standard musical notation.

BRIEF SUMMARY OF THE INVENTION

In accordance with a first aspect of the invention there is provided a method of programming a computer to create a two-dimensional graphical representation of music which has been analysed into a chord sequence, such that the computer is arranged to perform the following steps: evaluating a first parameter of each chord within the sequence; determining a first display coordinate for each chord in dependence on the evaluated first parameter; determining a second display coordinate in dependence on the time of occurrence of each chord within the sequence; and displaying the chords graphically at positions defined by the determined first and second display coordinates.

With such an arrangement, an aspect of the harmony of each chord within a sequence is caused to be displayed as a first coordinate within a graphical format, as opposed to merely the melody of the sequence. This enables a clear recognition of the harmonic sequence.

The first parameter preferably comprises the pitch of a selected one of the notes within the chord, and this note may be selected in accordance with a predetermined algorithm and/or be the root of the chord.

Since chords can usually be characterised by one of the notes of the chord, it is useful to select one of the notes for the first parameter. Thus, for example, the combination of the notes G, C and E imply a C major harmony, in which case the first parameter could be selected to be the note C.

In the event that the chord comprises more than one possible root note, the chord may be represented at more than one first coordinate in the graphical representation. Thus, for example the combination of notes A and C could imply either an F major harmony or an A minor harmony, in which case the first parameter could be selected to be both F and A. Equally, the root of the chord consisting of the notes C, E flat, F sharp and A could be any one of these notes, in which case the first parameter could be selected to be all of these four notes.

The scale along which the first coordinates are plotted within the graphical representation preferably defines a sequence of notes in which the interval between each pair of adjacent notes is the same. The interval is preferably a perfect fifth, since closely related chords, such as C major and G major would appear close together on the axis along which the first parameter of the chord sequence is plotted. In other circumstances, such as with jazz music, the interval may be selected to be a semitone.

Each chord within the sequence is preferably indicated graphically at its respective position by an indicium which is selected in accordance with a second parameter of the chord. The second parameter may define the harmonic nature of the chord, such as: major triad; minor triad; diminished triad; augmented triad; major seventh; dominant seventh; diminished seventh; half-diminished seventh; ninth; eleventh; thirteenth; suspended second; suspended fourth; and flat and sharp alterations.

When the chord is a major triad or a minor triad, a first indicium may be used when the root of the chord is the tonic of the music, and a second, different indicium may be used otherwise.

A linking indicium may be displayed between each adjacent pair of chords which indicates the transition between the two chords within the chord sequence, such as: relative minor to relative major; relative major to relative minor; tritone; or dominant seventh to tonic.

The first coordinate is preferably a y-axis and the second coordinate is an x-axis.

The centre position along the first coordinate axis preferably represents the tonic of the music. Since harmonic sequences tend to be "centred" about the tonic in the harmonic sense, this arrangement is likely to result in an efficient use of the display area, with the harmonic sequence, on average, being arranged about the centre line. Thus, for example, a piece of music in the key of C major, i.e. where C is the tonic, is likely to consist of modulations into the key of G major and also F major. Where the first parameter is plotted in fifths, this will result in chords within the sequence being plotted on the centre line, at one position above the centre line, for the G chords, and at one position below the centre line, for the F chords.

The computer may further be arranged to play the music which is displayed graphically, in which case the image of the displayed chords is preferably caused to move in time with the played music, such that a chord which is played at any given time is represented within the displayed chords at substantially the same position.

This arrangement provides a particularly useful teaching aid, since the student can appreciate the harmonic structure of the music, both visually and aurally.

In accordance with a second aspect of the invention there is provided apparatus for creating a two-dimensional graphical representation of music which has been analysed into a chord sequence, the apparatus comprising: means for evaluating a first parameter of each chord within the sequence; means for determining a first display coordinate for each chord dependence on the evaluated first parameter; means for determining a second display coordinate for each chord within the sequence in dependence on the time of occurrence of each chord within the sequence; and means for displaying the chords graphically at positions defined by the determined first and second display coordinates.

In accordance with a third aspect of the invention there is provided a method of programming a computer to create a two-dimensional graphical representation of a set of signals which define musical notes of different acoustic frequency and which have been analysed into sequence of combinations of musical notes of different acoustic frequency, such that the computer is arranged to perform the following steps: evaluating a first parameter of each combination within the sequence; determining a first display coordinate for each combination in dependence on the evaluated first parameter; determining a second display coordinate in dependence on the time of occurrence of each combination within the sequence; and displaying the set of signals graphically at positions defined by the determined first and second display coordinates.

The first parameter preferably comprises the frequency of a selected musical note within the combination.

The signals are preferably Musical Instrument Digital Interface (MIDI) signals.

The invention advantageously enables an entire piece of music to be viewed as a whole, and structures and patterns can be recognised visually that may not be apparent simply by listening or viewing the music in standard musical notation.

In a preferred embodiment, any piece of music can be analysed simply by rearranging the chords on the y-axis so that the tonic is in the middle.

The invention allows chords to be read directly from a chart in the same way that a jazz musician would use a lead sheet.

By studying the harmonic techniques used by composers of any kind of music using the invention, their compositional techniques are laid bare. Not only are the charts useful for analysing existing music, but also for original composition and song-writing. Entire songs can be composed simply by creating patterns and following simple visual rules. Additionally, individual styles of music can be recreated by imitating the harmonic structure of a genre or composer in a new piece.

BRIEF DESCRIPTION OF THE DRAWINGS

Preferred embodiments of the invention will now be described with reference to the accompanying drawings, in which:

FIG. 4 shows a table containing symbols used according to the preferred embodiment of the invention;

DETAILED DESCRIPTION

Figure 1:
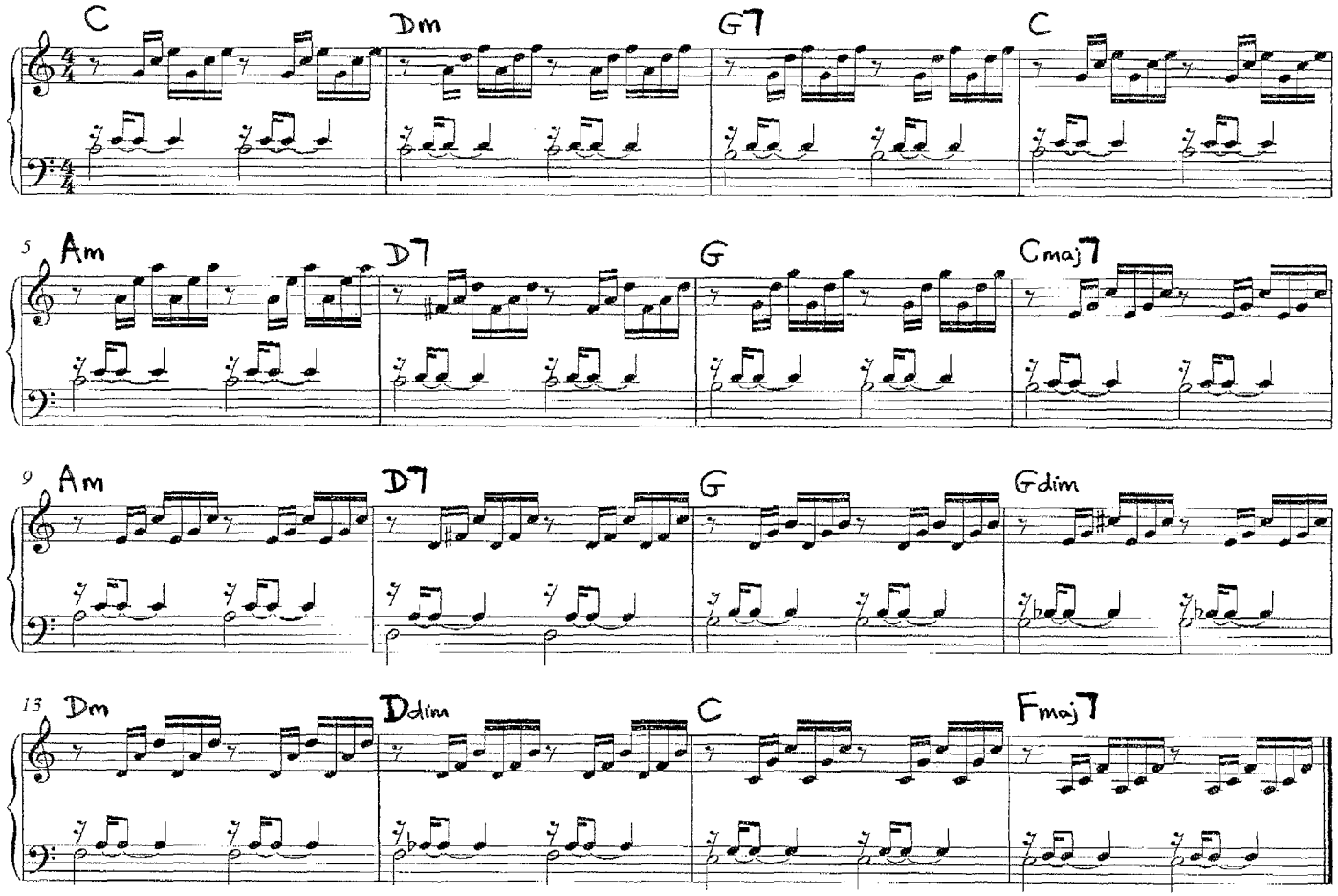
FIG. 1 shows a conventional stave representation of the first sixteen bars of Bach's First Prelude in C major from the Well Tempered Clavier Book I.
Figure 2:
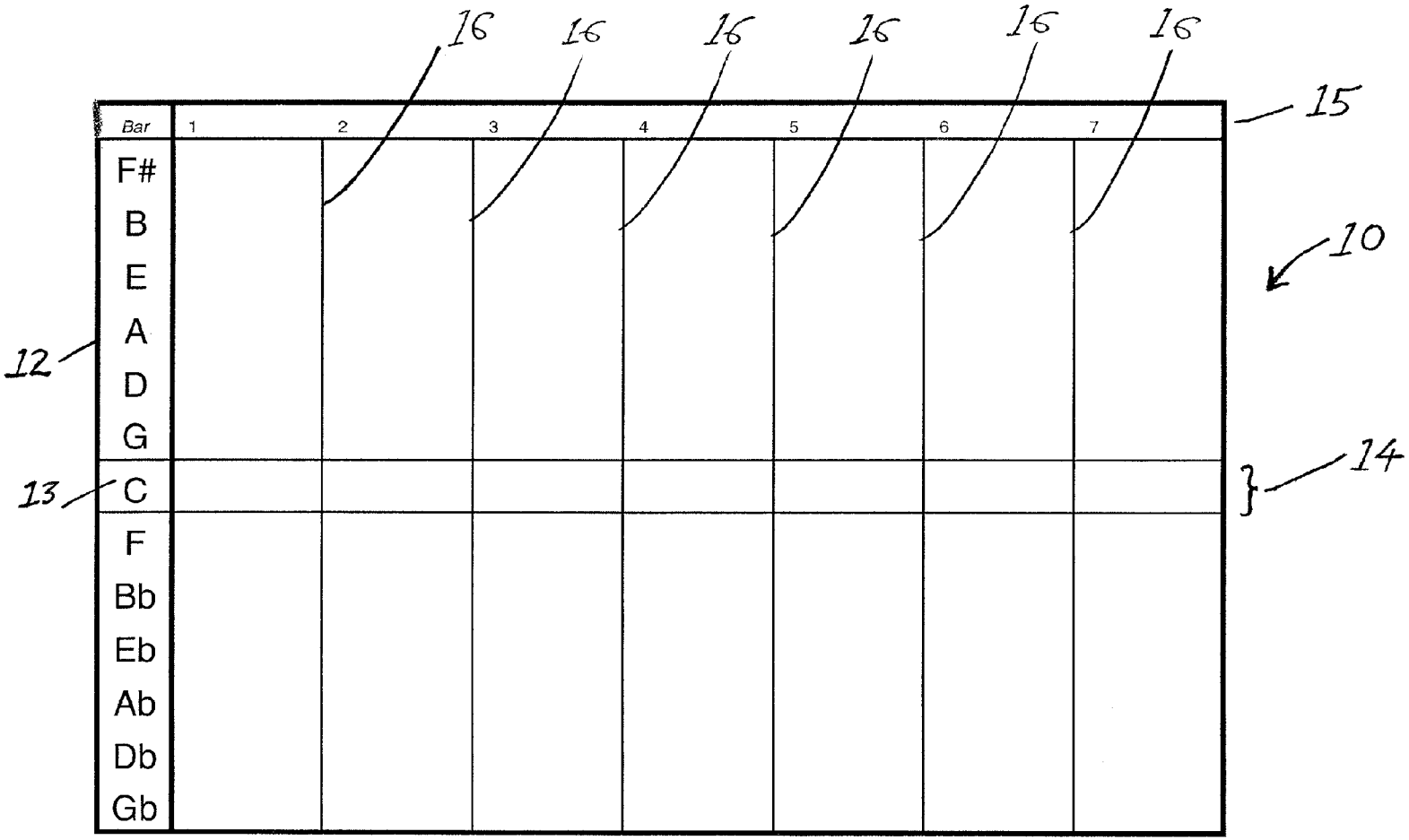
FIG. 2 shows a blank chart according to a preferred embodiment of the invention.

FIG. 2 shows a chart 10 for analysing the harmonic structure of a piece of music according to a preferred embodiment of the invention. Arranged vertically on the left-hand side of the chart 10 is a chord column 12 which comprises a sequence of notes. In the middle of the column resides the tonic or root note 13 of the piece of music represented on the chart 10. For the purpose of describing the invention clearly, the chart 10 shown in FIG. 2 does not have music represented on it. Extending above and below the root note 13 are the keys in order of ascending and descending perfect fifths respectively, according to the diatonic circle of fifths. This allows the strongest key relationships to be closest together. The skilled reader will notice that the note at the top of the chord column 12 is F sharp, which is enharmonically equivalent to the note G flat at the bottom of the chord column 12.

The chord column 12 represents a y-axis of the chart 10, and extending orthogonally from the middle of the y-axis is an x-axis 14 along which time is plotted. Time is measured in bars as indicated in a bar row 15 which extends orthogonally from the top of the y-axis parallel to the x-axis 14. Vertical lines 16 indicate the beginning of each bar subsequent to the first bar.

The first sixteen bars of J. S. Bach's First Prelude in C major from the Well Tempered Clavier Book I is displayed on the chart 10 in accordance with the invention in FIG. 3. This piece is in the key of C major, and the harmony of the first bar is C major, as indicated by a filled square 20 placed next to the root note 13 in the area of the chart 10 defined as the first bar of the piece. As will be appreciated by the reader, chords come in many types, such as major, minor, diminished, etc. The table shown in FIG. 4 illustrates the corresponding symbol used in the preferred embodiment of the invention for each type of chord. Of course, these symbols may be substituted by other symbols, as desired by the user.

Figure 3:
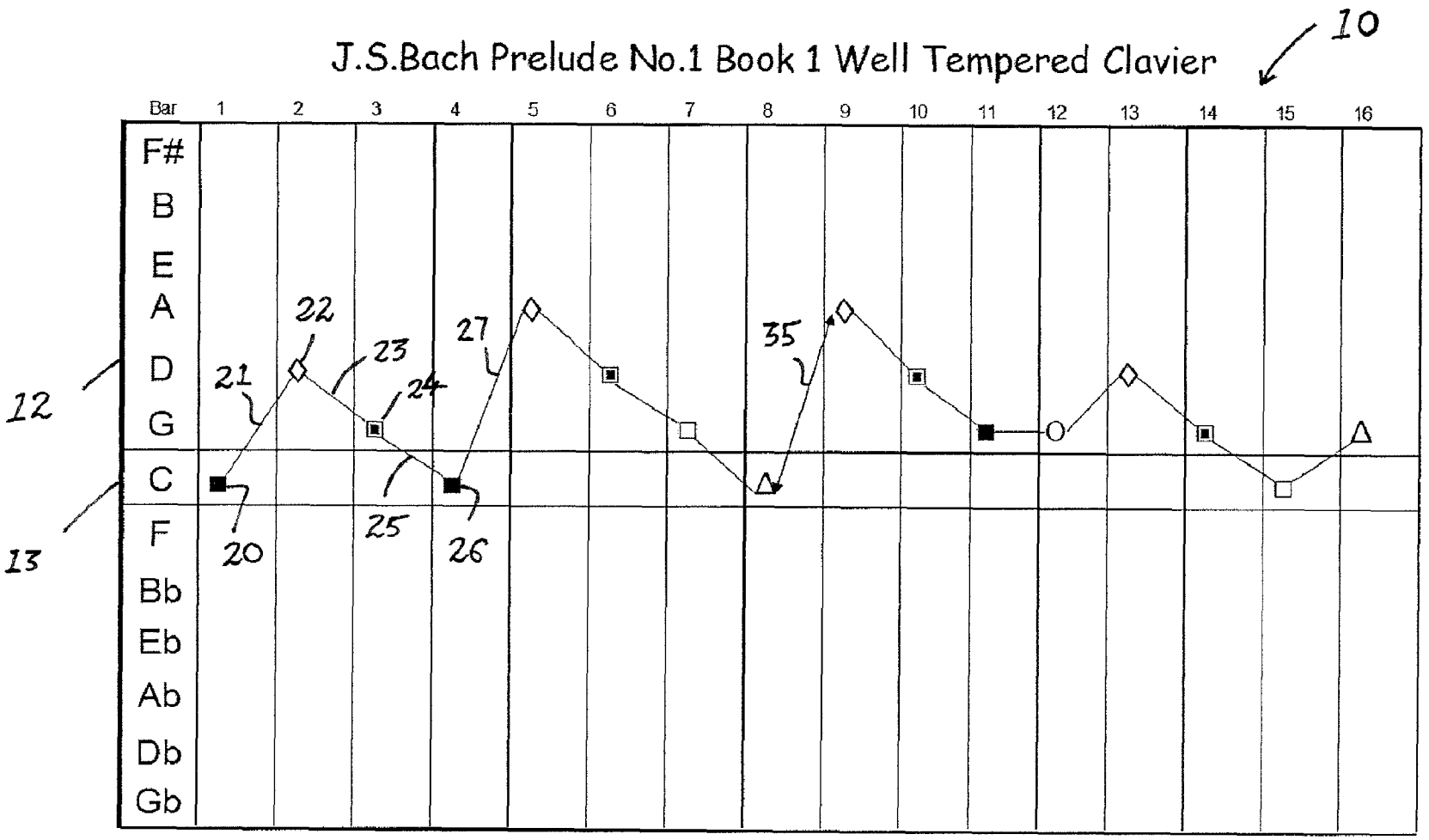
FIG. 3 shows the chart of FIG. 2 used to represent the first sixteen bars of Bach's First Prelude from the Well Tempered Clavier Book I.

Moving now to the second bar of the chart 10 shown in FIG. 3, the root of the chord played here is D minor. Therefore, as designated by the table in FIG. 4, an unfilled diamond 22 is placed in the second bar section of the chart 10 and positioned at the y-coordinate defined by the note D in the chord column 12. A straight line 21 is drawn between the filled square 20 and the unfilled diamond 22, as explained below.

Similarly to the first and second bars, the chord played in the third bar of the piece is indicated by placing a symbol in the third bar section of the chart 10. In this case, the harmony of the chord is G dominant $7^{th}$. Therefore, a partially filled square 24 is placed in the third bar section of the chart 10 and positioned at the y-coordinate defined by the note G in the chord column 12. A straight line 23 is drawn between the unfilled diamond 22 and the partially filled square 24, again as explained below.

For the sake of brevity, the remaining chords of the piece will not be described, since the method of the invention described above is used for all chords of the piece.

The relationship between adjacent chords is displayed diagrammatically by the use of connectors. A list of connectors used to do this is shown in FIG. 5.

Dominant $7^{th}$ chords are usually followed by a major or minor chord a perfect fifth below, e.g. a dominant $7^{th}$ chord on G is usually followed by a C major or minor chord. However, in the event that the subsequent chord is not the expected chord, the expected chord is indicated in dashed outline on the chart, and a suitable connector, also in the form of a dashed line, is included.

The skilled reader will be aware that a dominant $7^{th}$ chord is crucial to the establishment of a new key and is nearly always present just before a modulation. This relationship is known as a perfect cadence. Referring back to FIG. 3, the partially filled square 24 which represents a G dominant $7^{th}$ chord of the piece is followed by a C major chord, indicated in the appropriate position by a filled square 26. This chord change constitutes a perfect cadence, and, referring to the list in FIG. 5, a single-headed arrow 25 is drawn from the partially filled square 24 to the filled square 26. As can be clearly seen from FIG. 3, the next perfect cadences occur in bars six to seven, and ten to eleven, and these serve to establish a new temporary tonic for the piece.

Figure 5:
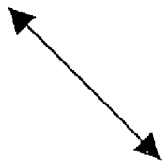
FIG. 5 shows a list of connectors which are used to illustrate the relationship between adjacent chords according to the preferred embodiment of the invention.
Figure 5:
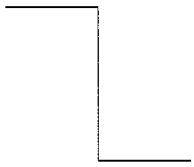
Figure 5:
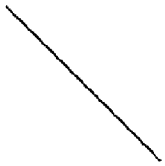
Figure 5:
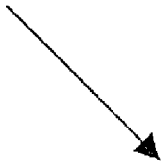

Using the list shown in FIG. 5, a relative major/minor connector in the form of a double-headed arrow 27 is used between bars four and five, and another relative major/minor connector 35 is used between bars 8 and 9. The remaining connectors will be self-explanatory by referring to FIG. 5.

Figure 6:
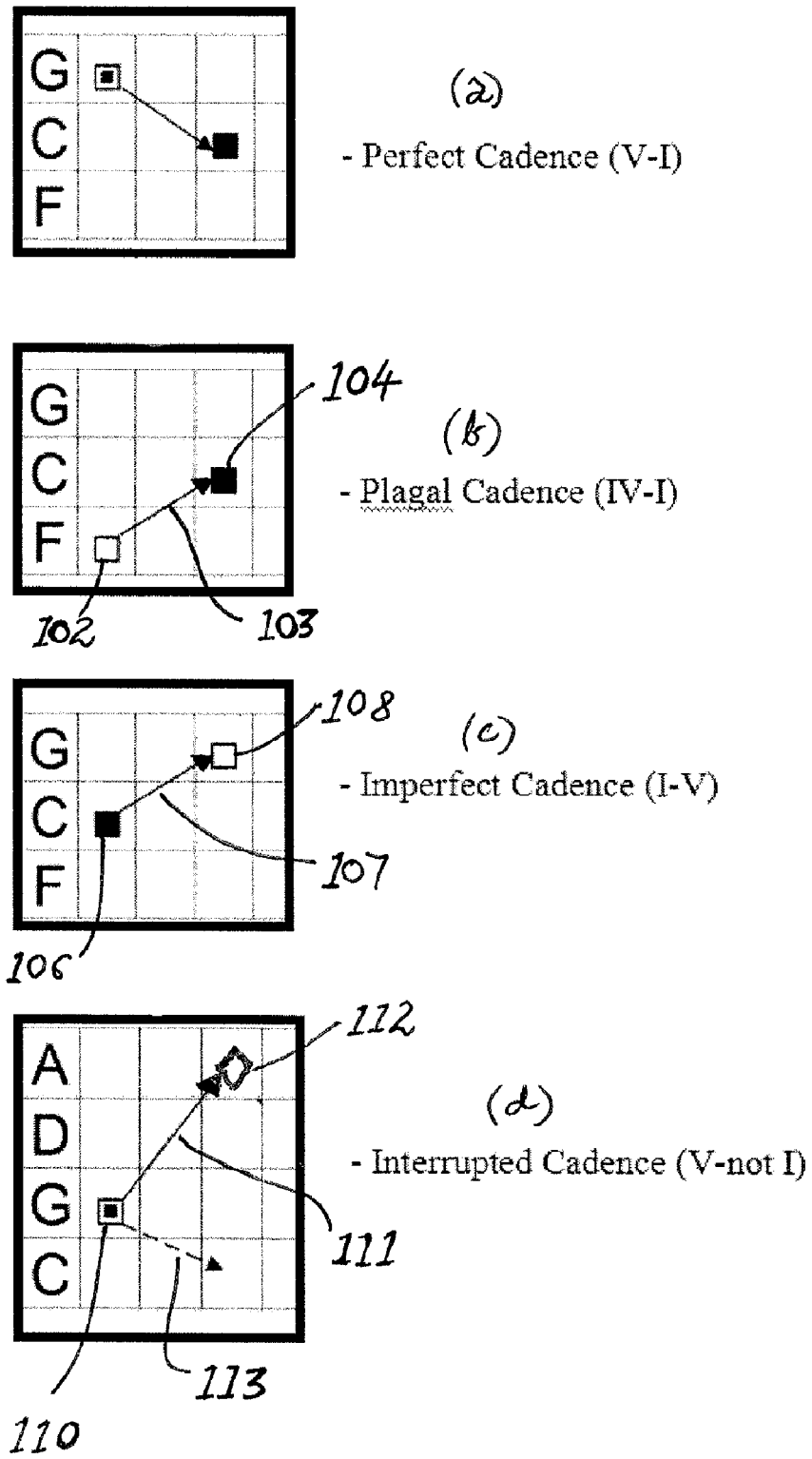
FIG. 6*a* shows an example of a perfect cadence according to the preferred embodiment of the invention.
FIG. 6*b* shows an example of a plagal cadence according to the preferred embodiment of the invention.
FIG. 6*c* shows an example of an imperfect cadence according to the preferred embodiment of the invention.
FIG. 6*d* shows an example of an interrupted cadence and an expected resolution according to the preferred embodiment of the invention.

The invention enables other cadences to be easily viewed. For example, FIG. 6*b* shows an F major chord 102 moving to a C major chord 104, and the representations of the two chords 102, 104 are connected by a connector 103. This is an example of a plagal cadence. FIG. 6*c* shows a C major chord 106 moving to a G major chord 108, which is an example of an imperfect cadence. Again, the representations of the two chords 106, 108 are connected by a connector 107. FIG. 6*d* shows a G dominant $7^{th}$ chord 110 moving to an A minor chord 112, which is an example of an interrupted cadence, where the representations of the two chords 110, 112 are connected by a connector 111. In the example shown in FIG. 6*d*, the expected move to the tonic root is shown with a dashed-line arrow 113. Thus, expected movement which does not occur or alternative movement can be highlighted by the invention.

For the purposes of illustration, Bach's First Prelude from the Well Tempered Clavier Book I has been used to describe the invention. Of course, any other piece of music may be analysed using the invention, and further examples are discussed below.

Figure 7A:
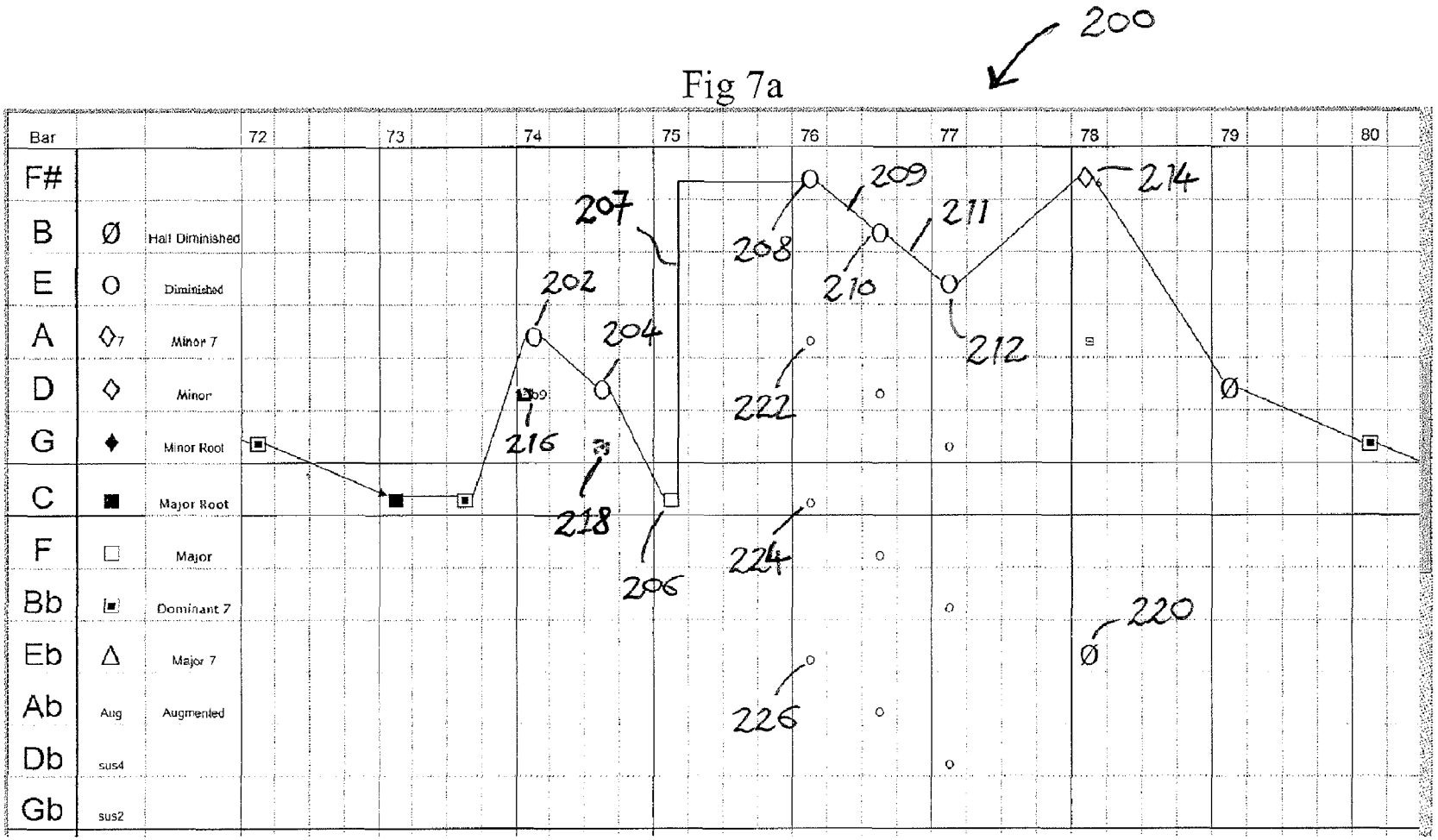
FIG. 7*a* shows a first interpretation of a passage from Chopin's Etude Op. 10 No. 1 according to the preferred embodiment of the invention.

Thus, an example of another piece of music which has been analysed according to the invention is shown on a chart 200 in FIG. 7*a*. The more complex harmonic movement of Chopin's Etude Op. 10 No. 1 is displayed. A feature of this piece is the diminished chords 202, 204, 208, 210, 212 which are often harmonically ambiguous. The two diminished chords 202, 204 in bar 74 act like dominant $7^{th}$ chords 216, 218 a fifth below. These suggested dominant $7^{th}$ chords 216, 218 have been added as small symbols which imply a harmonic movement descending down to C major in bar 75.

As will be appreciated by the skilled reader, diminished chords do not necessarily have an obvious root note. The invention advantageously allows all four notes of the diminished chords 208, 210, 212 to be shown on the chart 200 in bars 76 and 77. For example, the four notes of diminished chord 208 are F sharp 208, A 222, C 224, and E flat 226. Connectors 207, 209, 211 show one possible interpretation of the harmonic movement, namely a tritone jump from C to F sharp, followed by descending perfect fifths between diminished chords 208, 210, 212 in bars 75 to 77.

Chart 200 also contains a minor $6^{th}$ chord 214. Minor $6^{th}$ chords can also be ambiguous as they can be interpreted alternatively as half-diminished chords and vice versa. For example, the F sharp minor $6^{th}$ chord 214 can be interpreted as an E flat half-diminished chord 220. Often the lowest note of the chord will help in determining the identity of a chord, but it can be equally useful to add both chord symbols to the chart as shown in bar 78.

Figure 7B:
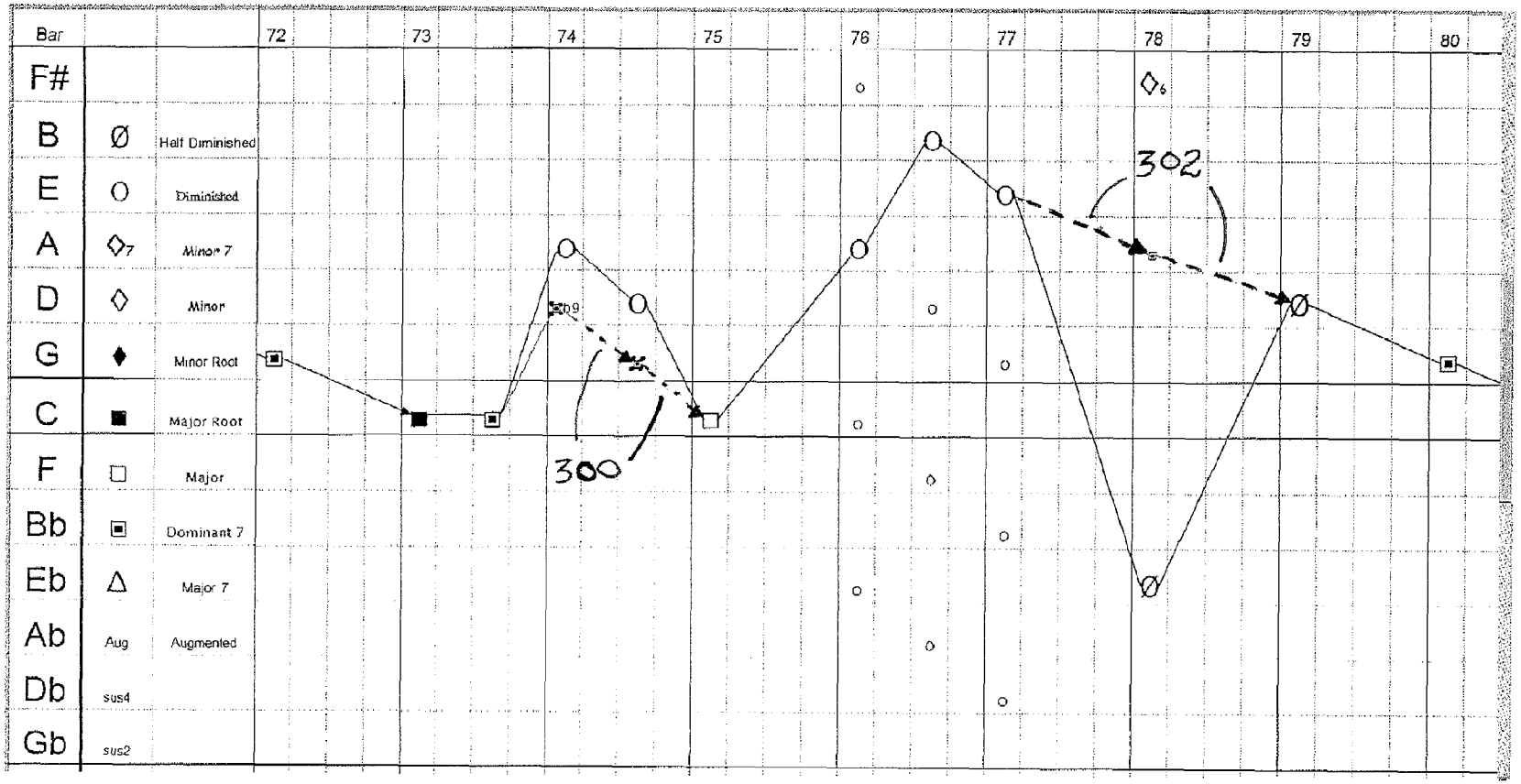
FIG. 7*b* shows a second interpretation of the passage from Chopin's Etude Op. 10 No. 1 shown in FIG. 7*a* according to the preferred embodiment of the invention.

FIG. 7*b* shows a different interpretation of the piece shown in FIG. 7*a*. In FIG. 7*b*, the suggested harmony is indicated by dashed-line connectors 300 in bar 74. Also, a different route has been taken through bars 77 to 79, as shown by dashed-line connectors 302. In contrast, the harmony moves in a chromatic fashion as seen in bars 77 to 78 of FIG. 7*a*. The "correct" interpretation is clearly open to discussion, but, without the visual aid of the invention, it would be far more difficult to see the different interpretations available.

Figure 8A:
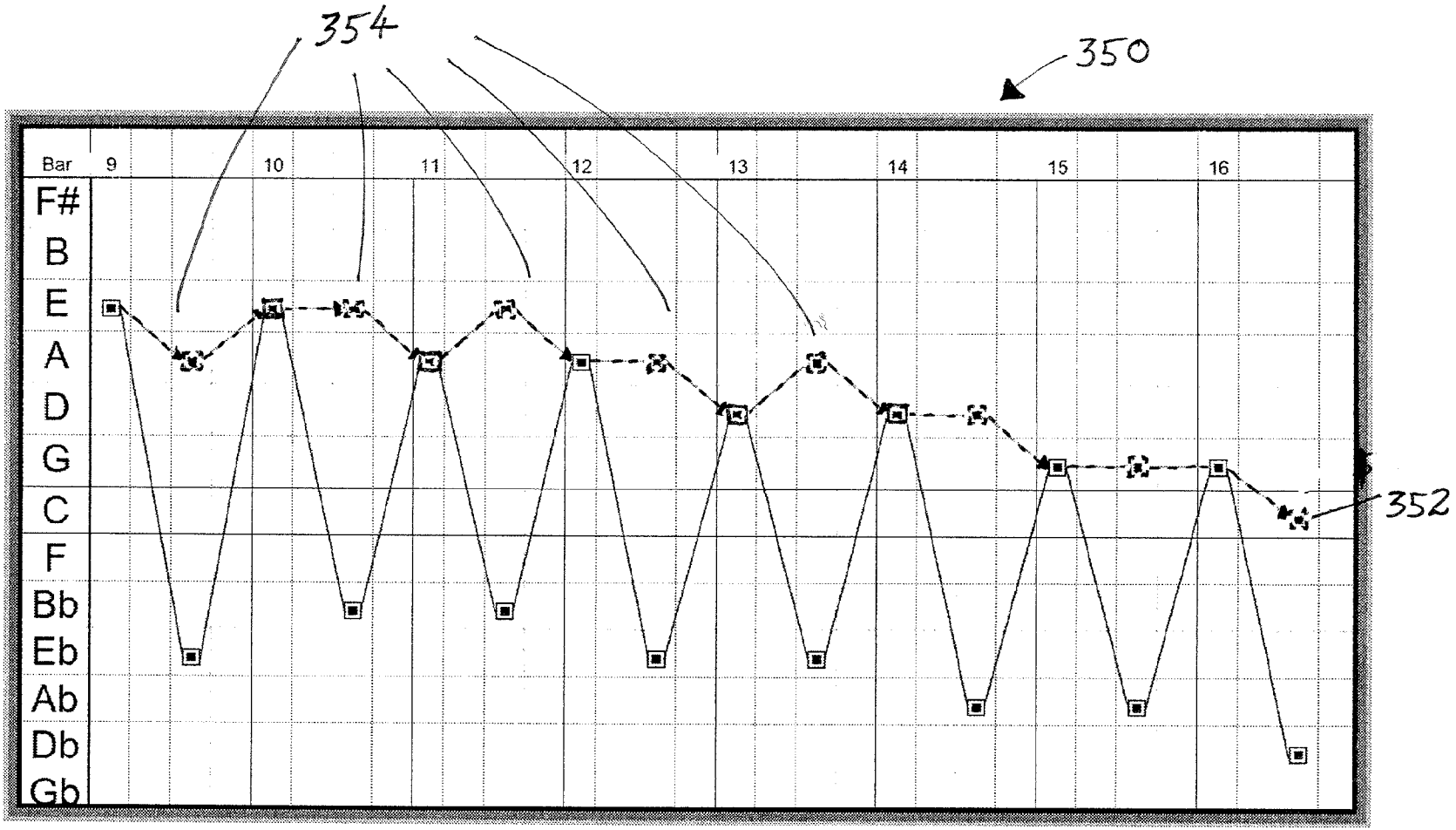
FIG. 8*a* shows a first interpretation of a jazz standard known as "Rhythm Changes" based on the harmony of "I got Rhythm" according to the preferred embodiment of the invention.

FIG. 8*a* shows a further piece of music using a representation in accordance with the invention. A chart 350 shows the suggested tritone counterparts of the chromatic shifts using dashed-line connectors 354. The invention allows the complex harmonic movement's true nature to be clearly shown as it descends slowly back towards the tonic root 352.

Figure 8B:
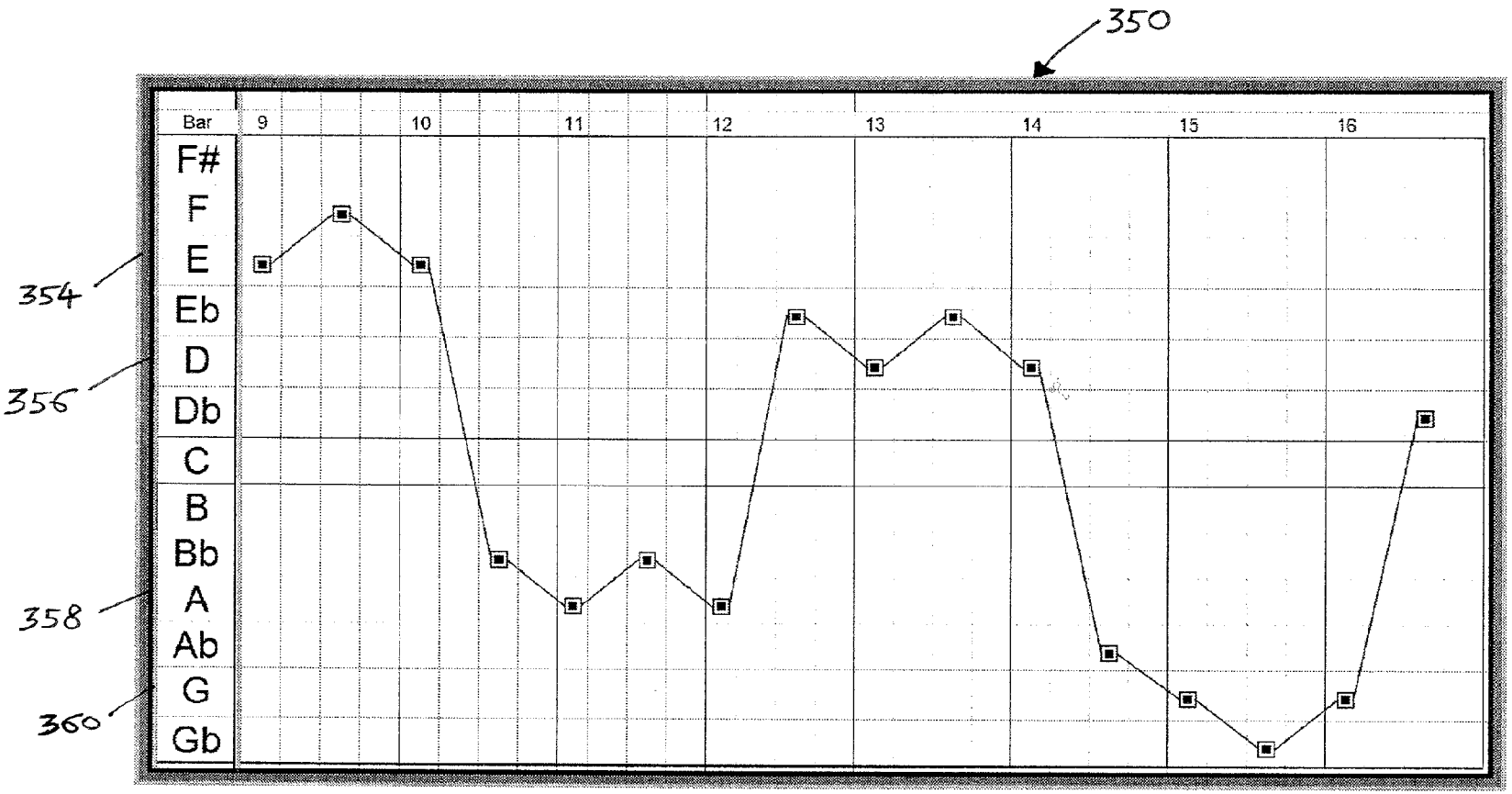
FIG. 8*b* shows a second interpretation of the jazz standard shown in FIG. 8*a* according to the preferred embodiment of the invention.

However, sometimes it can be useful to rearrange the chords along the y-axis with chromatically ascending and descending chords. In the interpretation shown in FIG. 8*b*, the suggested substitutions are omitted. In FIG. 8*b*, the chromatic movements of the chords E 354, A 358, D 356 and G 360 are clearly shown.

In a further preferred embodiment, a piece of music is played through one or more loudspeakers of a computer, and the harmonic sequence of the music being played is displayed dynamically on the computer screen such that the displayed chords move horizontally along the computer screen in time with the music. An indicium is also displayed which indicates the position of the chord being played through the loudspeakers.

Having described preferred embodiments of the invention, it is to be appreciated that these embodiments are merely exemplary, and that variations and modifications including modifications made to the chart or symbols, such as those that will occur to those possessed of the appropriate knowledge and skills, may be made without departure from the spirit and scope of the invention as set forth in the appended claims.

The invention claimed is:

1. A method of programming a computer to create a two-dimensional graphical representation of music which has been analysed into a chord sequence, such that the computer is arranged to perform the following steps:

evaluating the pitch of a root of each chord within the sequence;

determining a first display coordinate for each chord in dependence on the evaluated pitch;

determining a second display coordinate for each chord within the sequence in dependence on the time of occurrence of each chord within the sequence; and displaying the chords graphically at positions defined by the determined first and second display coordinates.

2. A method as claimed in claim 1, wherein said root is determined in accordance with a predetermined algorithm.

3. A method as claimed in claim 1, wherein, when the chord comprises more than one possible root note, the chord is represented at a corresponding more than one first coordinate in the graphical representation.

4. A method as claimed in claim 1, wherein the scale along which the first coordinates are plotted within the graphical representation defines a sequence of notes in which the interval between each pair of adjacent notes is the same.

5. A method as claimed in claim 4, wherein the interval is a perfect fifth.

6. A method as claimed in claim 4, wherein the interval is a semitone.

7. A method as claimed in claim 1, wherein each chord within the sequence is indicated graphically at its respective position by an indicium which is selected in accordance with a parameter of the chord.

8. A method as claimed in claim 7, wherein the computer accesses a database in which is stored data relating to a plurality of such indicia, and which is indexed in accordance with possible values of the parameter.

9. A method as claimed in claim 7, wherein the parameter defines the harmonic nature of the chord.

10. A method as claimed in claim 9, wherein the parameter is selected from the group consisting of: major triad; minor triad; diminished triad; augmented triad; major seventh; dominant seventh; diminished seventh; half-diminished seventh; ninth; eleventh; thirteenth; suspended second; suspended fourth; and flat and sharp alterations.

11. A method as claimed in claim 10, wherein the parameter is a major triad and a first indicium is used when the root of the chord is the tonic of the music, but a second, different indicium is used otherwise.

12. A method as claimed in claim 10, wherein the parameter is a minor triad and a first indicium is used when the root of the chord is the tonic of the music, but a second, different indicium is used otherwise.

13. A method as claimed in claim 1, further comprising displaying a linking indicium between each adjacent pair of chords within the chord sequence which indicates a transition between the two chords.

14. A method as claimed in claim 13, wherein the transition is selected from the group consisting of: relative minor to relative major; relative major to relative minor; tritone; and a cadence point.

15. A method as claimed in claim 1, wherein the first coordinate is a y-axis and the second coordinate is an x-axis.

16. A method as claimed in claim 1, wherein the centre position along the first coordinate axis represents the tonic of the music.

17. A method as claimed in any preceding claim, wherein the computer is further arranged to play the music which is displayed graphically.

18. A method as claimed in claim 17, wherein the computer is further arranged to cause the image of the displayed chords to move in time with the played music, such that a chord which is played at any given time is represented within the displayed chords at substantially the same position.

19. Apparatus for creating a two-dimensional graphical representation of music which has been analysed into a chord sequence, the apparatus comprising:

means for evaluating the pitch of a root of each chord within the sequence;

means for determining a first display coordinate for each chord dependence on the evaluated pitch;

means for determining a second display coordinate for each chord within the sequence in dependence on the time of occurrence of each chord within the sequence; and means for displaying the chords graphically at positions defined by the determined first and second display coordinates.

20. A method of programming a computer to create a two-dimensional graphical representation of a set of signals which defined musical notes of different acoustic frequency and which have been analysed into sequence of combinations of musical notes of different acoustic frequency, such that the computer is arranged to perform the following steps:

evaluating the acoustic frequency of a root of each combination within the sequence;

determining a first display coordinate for each combination in dependence on the evaluated acoustic frequency;

determining a second display coordinate in dependence on the time of occurrence of each combination within the sequence; and displaying the set of signals graphically at positions defined by the determined first and second display coordinates.

21. A method as claimed in claim 20, wherein the signals are Musical Instrument Digital Interface signals.

22. A method for graphically representing a chord sequence, the method comprising:

evaluating the pitch of a root of each chord within the sequence;

determining a first display coordinate for each chord in dependence on the evaluated pitch;

determining a second display coordinate for each chord within the sequence in dependence on the time of occurrence of each chord within the sequence; and displaying the chords graphically at positions defined by the determined first and second display coordinates.

23. A method as claimed in claim 22, the method further comprising:

evaluating a parameter of each chord within the sequence; and displaying each chord in the form of a symbol selected from a plurality of symbols in dependence on the parameter.

24. A method as claimed in claim 23, wherein the parameter is selected from the group consisting of: major triad; minor triad; diminished triad; augmented triad; major seventh; dominant seventh; diminished seventh; half-diminished seventh; ninth; eleventh; thirteenth; suspended second; suspended fourth; and flat and sharp alterations.

25. A method as claimed in claim 22, the method further comprising:

determining a relationship between adjacent chords;

displaying the relationship in the form of a linking indicium selected from a plurality of linking indicia in dependence on the relationship.

26. A method as claimed in claim 25, wherein the relationship is selected from the group consisting of: relative minor to relative major; relative major to relative minor; tritone; and dominant seventh to tonic.

27. A method as claimed in claim 25, wherein adjacent chords have more than one valid relationship, the method further comprising displaying said more than one valid relationship.

* * * * *